US006009949A

United States Patent [19]

Gano et al.

[11] Patent Number: 6,009,949

[45] Date of Patent: Jan. 4, 2000

[54] APPARATUS AND METHODS FOR SEALING A WELLBORE JUNCTION

[75] Inventors: John C. Gano, Carrollton; John S. Bowling, Dallas, both of Tex.

[73] Assignee: Halliburton Energy Services, Inc., Dallas, Tex.

[21] Appl. No.: 09/014,150

[22] Filed: Jan. 27, 1998

[51] Int. Cl.[7] ..... E21B 7/08

[52] U.S. Cl. ..... 166/313; 166/50; 166/117.6; 166/241.6

[58] Field of Search ..... 166/313, 50, 117.5, 166/117.6, 241.1, 241.6, 381, 382, 387

[56] References Cited

U.S. PATENT DOCUMENTS

| | | | |
|---|---|---|---|
| 5,325,924 | 7/1994 | Bangert et al. | 166/313 |
| 5,388,648 | 2/1995 | Jordan | 166/380 |
| 5,462,120 | 10/1995 | Gondouin | 166/380 |
| 5,472,048 | 12/1995 | Kennedy et al. | 166/50 |

FOREIGN PATENT DOCUMENTS

| | | | |
|---|---|---|---|
| 0859124 | 8/1998 | European Pat. Off. . | |
| 2297779 | 8/1996 | United Kingdom . | |
| 2304764 | 3/1997 | United Kingdom | E21B 43/30 |

*Primary Examiner*—Roger Schoeppel
*Attorney, Agent, or Firm*—William M. Imwalle; Marlin R. Smith

[57] ABSTRACT

A sealed wellbore junction is conveniently and efficiently created in a subterranean well. In one described embodiment, a first assembly including a deflection device is positioned in the well adjacent a junction of parent and lateral wellbores. A second assembly is then sealingly engaged with the first assembly, thereby sealing the junction, and providing fluid communication between the lateral wellbore and upper and lower portions of the parent wellbore. Sealing engagement between the first and second assemblies may be provided by a variety of sealing members, or by metal-to-metal contact between the assemblies.

36 Claims, 3 Drawing Sheets

APPARATUS AND METHODS FOR SEALING A WELLBORE JUNCTION

BACKGROUND OF THE INVENTION

The present invention relates generally to operations performed in conjunction with a subterranean well and, in an embodiment described herein, more particularly provides a sealed wellbore junction utilizing novel apparatus and methods.

Although it is common practice to drill one or more lateral wellbores extending outwardly from a parent wellbore, sealing junctions between the parent wellbore and the lateral wellbores has presented difficult problems for designers of drilling and completion systems. One of the basic problems has been to provide fluid communication with, and access to, each of the wellbores while isolating the earthen formation surrounding the junction from fluids produced from, or injected into, the wellbores.

Various solutions to this problem have been proposed, many of which involve using cement to isolate the junction from fluid flow through the wellbores. However, it would be advantageous to instead use a more ductile and accurately dimensioned material, such as metal, to construct a pressure-bearing conduit for fluid flow through the junction between the wellbores. Unfortunately, the constraints of working within the confines of a well, and the need for passing equipment having specified diameters through flow passages of the junction, have heretofore resisted attempts at a convenient and economical solution to this problem.

For example, it may be dimensionally impossible in certain situations to convey flow passages for a lateral wellbore and for a lower portion of the parent wellbore side-by-side into the well. This is especially so where the diameter of the parent wellbore above the junction is less than the combined diameters of the lower parent wellbore and lateral wellbore flow passages. Therefore, it may be necessary or desirable to separately convey these flow passages into the well.

However, if the flow passages are separately conveyed into the well, they must be joined together later within the well. This presents the problem of arranging and sealingly engaging the members in which the flow passages are formed within the confines of the well.

From the foregoing, it can be seen that it would be quite desirable to provide a method of sealing a wellbore junction which does not rely solely upon cement for sealing the junction, but which conveniently and economically results in a sealed junction having relatively large diameter flow passages for each wellbore. It is accordingly an object of the present invention to provide such a method and associated apparatus.

SUMMARY OF THE INVENTION

In carrying out the principles of the present invention, in accordance with an embodiment thereof, a sealed wellbore junction is provided using unique methods and apparatus described herein. The method involves joining and sealingly engaging multiple assemblies within the well. The apparatus includes multiple flow passages which are aligned with, and placed in fluid communication with, each of the wellbores.

In broad terms, a method is provided which includes the steps of positioning a first assembly in one of the wellbores proximate the wellbore junction. A second assembly is then sealingly engaged with the first assembly. Axial flow passages formed through the first and second assemblies are aligned, thereby providing fluid communication between the upper and lower parent wellbores, and a lateral flow passage formed through a sidewall of the second assembly is aligned with the lateral wellbore.

In one aspect of the present invention, the first and second assemblies are sealingly engaged by displacing a sleeve so that it extends through an interface between the first and second assemblies. The sleeve forms a portion of the axial flow passages and each end of the sleeve is sealed within one of the first and second assemblies. An anchoring device may secure the sleeve in position, and the anchoring device may bias the first and second assemblies toward each other, thereby maintaining the engagement therebetween.

In another aspect of the present invention, the first and second assemblies may be sealingly engaged by axial contact therebetween. This may be accomplished in a variety of ways, including providing a seal member between the assemblies, or by effecting a metal-to-metal seal between the assemblies.

In still another aspect of the present invention, the first assembly includes a deflection device having a laterally inclined upper surface formed thereon. The deflection surface has a shoulder which engages a housing of the second assembly. In this manner, the second assembly is prevented from displacing relative to the first assembly. Furthermore, an anchoring device may be set in the upper parent wellbore to bias the second assembly into contact with the first assembly.

These and other features, advantages, benefits and objects of the present invention will become apparent to one of ordinary skill in the art upon careful consideration of the detailed description of representative embodiments of the invention hereinbelow and the accompanying drawings.

DETAILED DESCRIPTION

Figure 1:
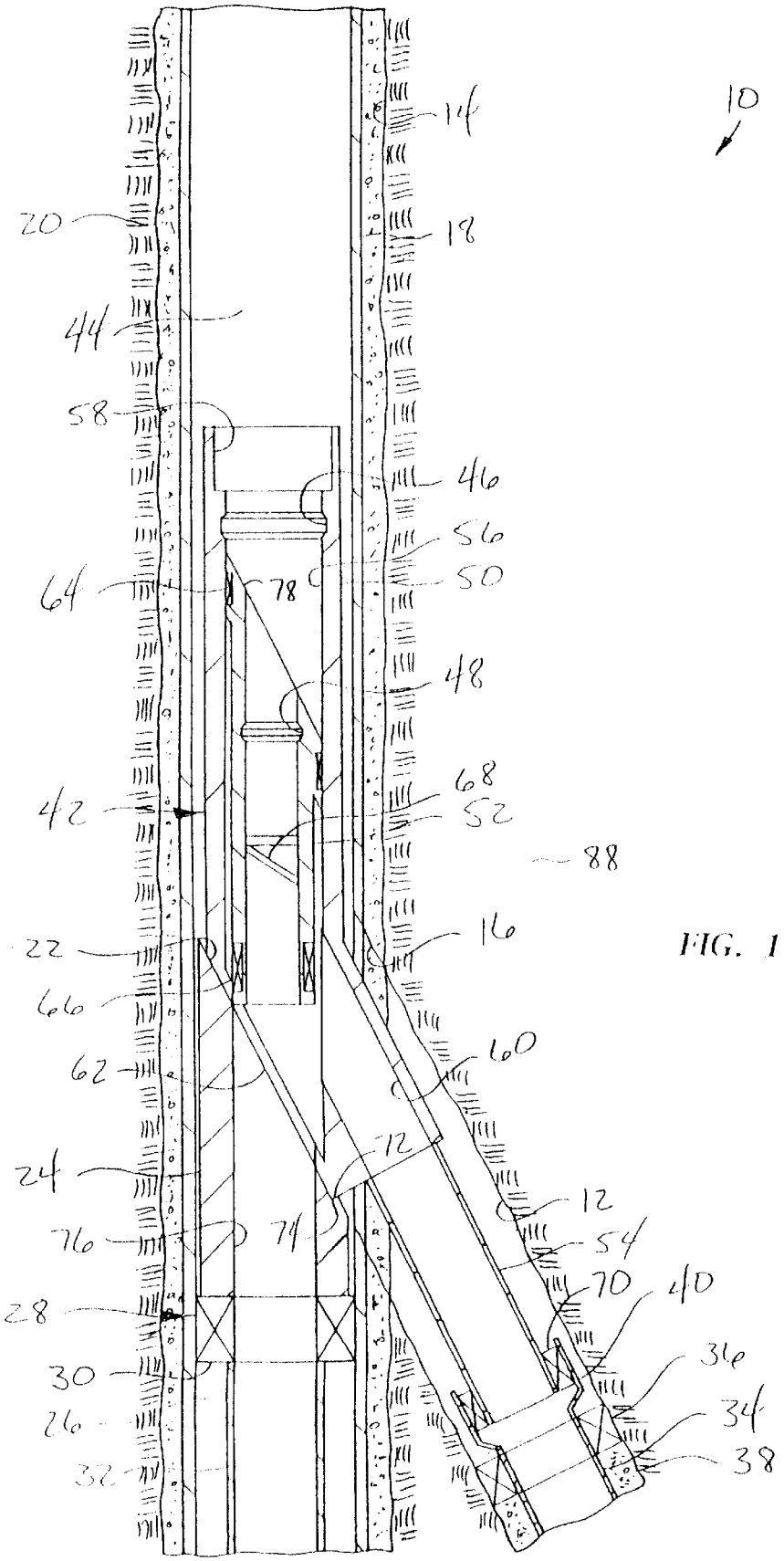
FIG. 1 is a schematic cross-sectional view of a first method and apparatus embodying principles of the present invention, initial steps of the method having been performed.

Schematically and representatively illustrated in FIG. 1 is a method 10 which embodies principles of the present invention. In the following description of the method 10 and other methods and apparatus described herein, directional terms, such as "above", "below", "upper", "lower", etc., are used for convenience in referring to the accompanying drawings. The drawings are not necessarily to scale. Additionally, it is to be understood that the various embodiments of the present invention described herein may be utilized in various orientations, such as inclined, inverted, horizontal, vertical, etc., without departing from the principles of the present invention.

As shown in FIG. 1, initial steps of the method 10 have been performed. A lateral wellbore 12 has been drilled intersecting a parent wellbore 14 via a window 16 formed laterally through protective casing 18 and cement 20 lining the parent wellbore. In drilling the lateral wellbore 12, one or more cutting tools (not shown in FIG. 1), such as mills, drill bits and reamers, have been deflected laterally off of an upper laterally inclined deflection surface 22 of a whipstock or other deflection device 24 positioned in a lower portion 26 of the parent wellbore 14 adjacent the intersection of the parent and lateral wellbores. Note that the deflection device 24 representatively illustrated in FIG. 1 is not necessarily the same deflection device used in initial milling of the window 16 through the casing 18 or drilling of the lateral wellbore 12, since the deflection device may have been changed out during, or subsequent to, these operations.

The deflection device 24 is a part of an overall assembly 28 positioned in the lower parent wellbore 26 before the lateral wellbore 12 has been drilled. The assembly 28 also includes a tailpipe, casing, liner or other tubular member 32 sealingly and threadedly attached to, and extending downwardly from, a packer 30 interconnected between the deflection device 24 and the tubular member 32. The assembly 28 is radially and axially oriented relative to the lateral wellbore 12 using conventional methods, such as by using a gyroscope survey tool and orienting nipple, high-side detector, etc., and the packer 30 is set in the lower parent wellbore 26 to thereby anchor the assembly therein and maintain the deflection surface 22 facing toward the lateral wellbore-to-be-drilled.

After the lateral wellbore 12 has been drilled, a liner 34 or other tubular member is lowered through the parent wellbore 14 from the earth's surface and laterally deflected off of the deflection surface 22 to pass through the window 16 and into the lateral wellbore. The liner 34 is sealed within the lateral wellbore 12, for example, by an inflatable packer 36 and cement 38. As shown in FIG. 1, the packer 36 is interconnected between the liner 34 and a polished bore receptacle (PBR) 40.

Another assembly 42 is then conveyed into the parent wellbore 14 and engaged with the assembly 28 and liner 34 (via the PBR 40 and packer 36 sealingly attached therebetween). For convenience and clarity of illustration, FIG. 1 has been foreshortened and the apparatus shown therein have been enlarged with respect to the wellbores 12, 14, but it is to be clearly understood that the assembly 42 is preferably configured so that it may pass through at least an upper portion 44 of the parent wellbore 14.

The assembly 42 may be conveyed into the well by any of a variety of conveyances, including segmented tubing, coiled tubing, wireline, slickline, a work string, etc. A conventional running tool (not shown in FIG. 1) of the type well known to those skilled in the art, appropriately modified if necessary to conform to the dimensional characteristics of the assembly 42, is preferably attached to the assembly when it is conveyed into the well. For this purpose, annular recesses or latching profiles 46, 48 are formed internally on the assembly 42. Of course, depending upon the particular type of running tool used, the recesses or profiles 46, 48 may be differently configured and differently positioned, or may not be used at all. Additionally, it is not necessary for a running tool to be used in a method incorporating principles of the present invention.

The assembly 42 includes a housing 50, a sleeve 52 axially reciprocably disposed within the housing, and a tubular member or liner 54 sealingly and threadedly attached to the housing. The housing 50 has a flow passage 56 formed axially therethrough, a PBR or seal bore 58 at an upper end thereof, a flow passage 60 formed laterally through a sidewall of the housing and intersecting the axial flow passage, and a lower laterally inclined surface 62 The surface 62 is complementarily shaped relative to the deflection surface 22 of the deflection device 24.

The sleeve 52 has a seal device or member 64 carried proximate an upper end, and a seal device or member 66 carried proximate a lower end thereof. A conventional orienting profile 68 is formed internally on the sleeve 52 for radially orienting the assembly 42 with respect to the well and, in particular, for ensuring that the assembly 42 is properly aligned with the assembly 28 and lateral wellbore 12 as more fully described below. However, it is to be understood that the orienting profile 68 may be formed on another portion of the assembly 42, such as the housing 50, and that other means of orienting the assembly may be utilized without departing from the principles of the present invention.

As shown in FIG. 1, the sleeve 52 is in an upwardly disposed position with respect to the housing 50. As will be described more fully below, the sleeve 52 is downwardly displaced relative to the housing 50 by the running tool when it is desired to sealingly engage the assembly 28. To maintain the sleeve 52 in its position as shown in FIG. 1, shear pins, collets, locking dogs, or another retaining device (not shown) may be used to releasably secure the sleeve relative to the housing 50. Alternatively, the sleeve 52 may be axially and/or rotationally secured relative to the housing 50 by the running tool, depending upon the particular running tool utilized.

The tubular member 54 is threadedly and sealingly attached to the housing 50 in fluid communication with the flow passage 60. As the assembly 42 approaches the assembly 28, the tubular member 54 is laterally deflected off of the deflection surface 22 and enters the lateral wellbore 12. It will be readily appreciated that such deflection of the tubular member 54 may be utilized to rotationally orient the assembly 42 with respect to the assembly 28 and the lateral wellbore 12, whether or not a separate orienting tool is also utilized for this purpose.

Eventually, a seal member or device 70 carried on the tubular member 54 engages and is received within the PBR 40 and the housing surface 62 axially contacts the deflection surface 22. A shoulder 72 formed on the deflection surface 22 engages a shoulder 74 of the housing 50, thereby preventing further downward displacement of the assembly 42 relative to the assembly 28. Of course the shoulders 72, 74 may be differently shaped as compared to those shown in FIG. 1 without departing from the principles of the present invention, for example, the shoulders may be a cooperating projection and recess, etc.

Note that engagement of the shoulders 72, 74 performs several functions in the method 10. The axial bore 56 of the assembly 42 is aligned with an axial bore 76 formed through the deflection device 24. The seal device 70 is positioned axially within the PBR 40. Additionally, the assembly 42 is appropriately positioned within the parent wellbore 14, with a portion of the housing 50 having the lateral flow passage 60 formed therein extending into the lateral wellbore 12.

Figure 2:
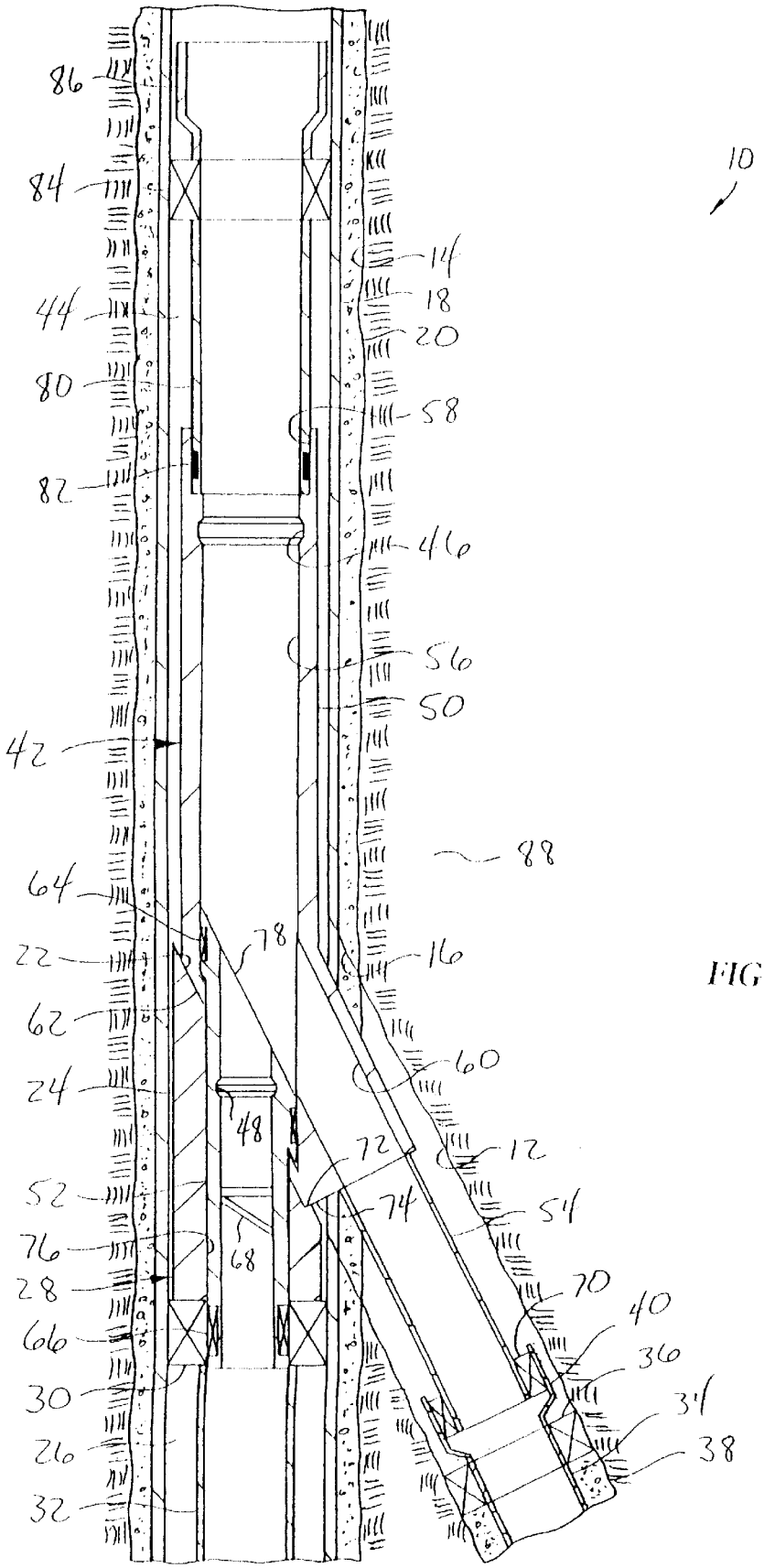
FIG. 2 is a schematic cross-sectional view of the first method and apparatus, wherein additional steps of the method have been performed.

Referring additionally now to FIG. 2, the method 10 is schematically and representatively illustrated with the sleeve 52 in its downwardly disposed configuration relative to the housing 50. Such downward displacement of the sleeve 52 may be caused by, for example, the running tool used to convey the assembly 42 into the well, by a separate shifting tool, etc. The sleeve 52 now extends into each of the axial flow passages 56, 76 through the interface between the housing 50 and the deflection device 24, with the seal device 64 sealingly engaged within the housing below the intersection of the axial flow passage 56 and the lateral flow passage 60, and the seal device 66 sealingly engaged within the packer 30. Thus, the sleeve 52 forms a pressure-bearing conduit between the flow passage 56 extending upwardly into the upper parent wellbore 44 and the flow passage 76 extending downwardly into the lower parent wellbore 26.

Of course, the sleeve 52 could be otherwise positioned and the sealing devices 64, 66 could be sealingly engaged with other portions of the assemblies 28, 42, without departing from the principles of the present invention. Additionally, note that it is not necessary for the sleeve 52 to be downwardly displaced relative to the housing 50 to this position. For example, the sleeve 52 could be initially received within the deflection device 24, and then upwardly displaced relative to the deflection device and inserted into the housing 50 after the assemblies 28, 42 are engaged.

The sealing device 64 could be packing, an oring, one or more other seal elements, and the sealing device 64 may have one or more slips or other anchoring devices associated therewith. Additionally, the sealing device 64 could be a packer, an anchor, a liner hanger, etc. If the sealing device 64 includes an anchoring device, or a latching or anchoring device is otherwise engaged between the sleeve 52 and the housing 50, the anchoring device may be used to secure the sleeve relative to the housing.

The sealing device 66 could be similar to the sealing device 64 or it could be differently configured. For example, the sealing device 64 may be packing, while the sealing device 66 may be a packer. If the sealing device 66 is a packer or other device which includes a latching or anchoring device, such as one or more slips, etc., the anchoring device may be used to secure the sleeve 52 relative to the packer 30 or other portion of the assembly 28. Note that, by securing the sleeve 52 against displacement relative to the assembly 28, the assemblies 28, 42 are thereby secured against displacement relative to each other. Furthermore, setting of an anchoring device, such as one associated with the sealing device 66, may be utilized to bias the assemblies 28, 42 toward each other, thereby maintaining axial contact between the surfaces 22, 62 and engagement between the shoulders 72, 74, and stabilizing the wellbore connection. For example, if the sealing device 66 is a packer, the sleeve 52 may be attached to an inner mandrel or other element of the packer, and when the packer is set, the inner mandrel may exert a downwardly biasing force on the sleeve.

Similarly, the sealing device 70 may be sealingly engaged in another portion of the lateral wellbore 12, or in another item of equipment therein. For example, the sealing device 70 may be an inflatable packer directly sealingly engaged with the walls of the wellbore 12, or the sealing device 70 may be a production packer sealingly and grippingly engaged within the PBR 40 and exerting a biasing force on the tubular member 54, etc. Thus, the sealing device 70 may also operate to maintain the assembly 42 in engagement with the assembly 28.

With the sleeve 52 in its downwardly disposed configuration, an upper laterally inclined end surface 78 of the sleeve is aligned with the lateral flow passage 60. In this manner, the end surface 78 may be used to laterally deflect tubing, tools, and other items of equipment from the flow passage 56 to the flow passage 60. For example, a logging tool (not shown) lowered into the upper wellbore 44 may be deflected laterally by the end surface 78 if the logging tool or an end portion thereof has a diameter greater than that formed axially through the sleeve 52.

Of course, it is not necessary for the sleeve 52 to have an axial bore with a diameter less than that of the flow passage 60, and items of equipment may be otherwise deflected or guided into the lateral wellbore 12, in keeping with the principles of the present invention. For example, the profile 68 may be used to position and radially align a deflecting device (not shown) relative to the flow passage 60, the deflecting device closing off the end 78, so that it is not necessary for a logging tool or other item of equipment to have a diameter greater than that formed axially through the sleeve 52, in order for the tool to be deflected into the lateral wellbore 12.

A liner 80 or other tubular member is sealingly engaged with the seal bore 58, for example, with a circumferential sealing device 82 carried on the liner 80. The liner 80 is sealingly and grippingly secured within the upper parent wellbore 44 by a packer 84 attached thereto and set in the casing 18. However, the housing 50 or other portion of the assembly 42 could be directly sealingly and/or grippingly engaged with the casing 18 without utilizing the liner 80, sealing device 82 and packer 84, for example, by a packer attached directly to the housing and set within the casing, without departing from the principles of the present invention. A PBR 86 attached above the packer 84 permits subsequent sealing engagement of flow control devices, test tools, tubing, etc.

Note that, at this point in the method 10, a formation 88 immediately surrounding the wellbore junction is isolated from fluid communication with the flow passage 60 extending into the lateral wellbore 12, the flow passage 76 extending into the lower parent wellbore 26, and the flow passage 56 extending into the upper parent wellbore 44. Note also that fluid is prevented from migrating between the formation 88 and other formations intersected by the wellbores 12, 14 through the wellbore junction. Of course, further assurance against such fluid communication and migration may be obtained by filling voids between the assemblies 28 42 and the wellbores 12, 14 with cement or other sealing material. Additional structural support may be provided to the assemblies 28, 42 by such material, although its use is not necessary.

Figure 3:
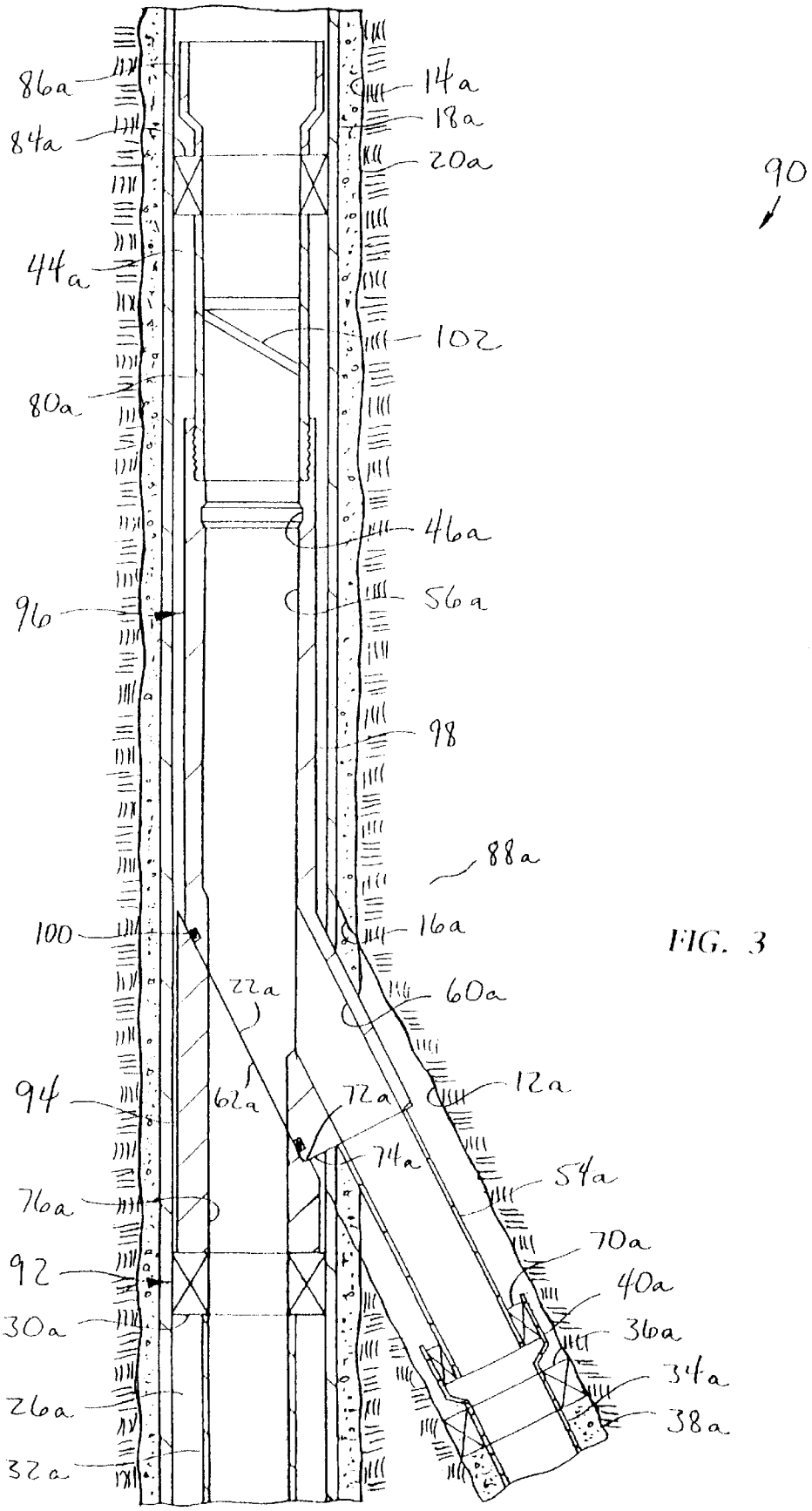
FIG. 3 is a schematic cross-sectional view of a second method and apparatus embodying principles of the present invention.

Referring additionally now to FIG. 3, a method 90 is schematically and representatively illustrated, the method embodying principles of the present invention. In many respects, the method 90 is similar to the previously described method 10. Elements shown in FIG. 3 which are similar to previously described elements of the method 10 are indicated using the same reference numbers, with an added suffix "a".

In the method 90, similar to the method 10, an assembly 92 including a deflection device 94 is engaged with another assembly 96 including a housing 98 having the flow passages 56*a*, 60*a* formed therethrough within the well. However, note that, in the method 90 shown in FIG. 3, the surfaces 22*a*, 69*a* are sealingly engaged, thus permitting pressure-bearing fluid communication between the flow passages 56*a*, 76*a*, without use of the sleeve 52 positioned therethrough. For this purpose, a seal 100 is carried on the housing 98, but it is to be understood that the seal could be carried on the deflection device 94 or another portion of the assemblies 92, 96, a portion of the assembly 96 may be sealingly received in a portion of the assembly 92, and vice versa, a metal-to-metal seal may be created by contact between the surfaces 22*a*, 62*a*, and the assemblies 92, 96 may be otherwise sealingly engaged without departing from the principles of the present invention.

The housing 98 is sealingly and threadedly attached to the tubular member 80*a*, which has an orienting profile 102 formed therein for orienting the assembly 96 relative to the well, and in particular, relative to the lateral wellbore 12*a*. In this case, the tubular member 80*a*, packer 84*a* and PBR 86*a* are part of the assembly 96 and are conveyed into the well therewith. Thus, it may be seen that many variations may be made in the methods described herein without departing from the principles of the invention.

As with the method 10, the method 90 isolates the formation 88*a* immediately surrounding the wellbore junction from fluid communication with the flow passage 60*a* extending into the lateral wellbore 12*a*, the flow passage 76*a* extending into the lower parent wellbore 26*a*, and the flow passage 56*a* extending into the upper parent wellbore 44*a*. Fluid is also prevented from migrating between the formation 88*a* and other formations intersected by the wellbores 12*a*, 14*a* through the wellbore junction. And again, further assurance against such fluid communication and migration may be obtained by filling voids between the assemblies 92, 96 and the wellbores 12*a*, 14*a* with cement or other sealing material.

Of course, many other variations, modifications, additions, substitutions, deletions and other changes may be made in the methods and apparatus described above, which changes would be obvious to a person skilled in the art, and such changes are contemplated by the principles of the present invention. Accordingly, the foregoing detailed description is to be clearly understood as being given by way of illustration and example only, the spirit and scope of the present invention being limited solely by the appended claims.

What is claimed is:

1. Apparatus operatively positionable within a subterranean well, the apparatus comprising:

first and second assemblies sealingly engaged with each other, each of the first and second assemblies having an axial flow passage formed therethrough, the second assembly having a lateral flow passage formed through a sidewall thereof, and the second assembly being biased into axial contact with an upper laterally inclined surface of the second assembly.

2. The apparatus according to claim 1, wherein sealing engagement between the first and second assemblies is provided by a sleeve received within each of the axial flow passages.

3. The apparatus according to claim 2, wherein the sleeve is anchored within at least one of the axial flow passages.

4. The apparatus according to claim 1, wherein sealing engagement between the first and second assemblies is provided by a seal member disposed adjacent an interface between the first and second assemblies.

5. The apparatus according to claim 1, wherein sealing engagement between the first and second assemblies is provided by metal-to-metal engagement between the first and second assemblies.

6. The apparatus according to claim 1, further comprising an anchoring device biasing the first and second assemblies into engagement with each other.

7. Apparatus operatively positionable within a subterranean well, the apparatus comprising:

a first assembly including a deflection device having a first flow passage formed generally axially therethrough; and a second assembly cooperatively engaged with the first assembly, the second assembly including a second flow passage formed generally axially therethrough and generally aligned with the first flow passage, a third flow passage formed through a sidewall portion of the second assembly, and a sleeve extending axially within each of the first and second flow passages and sealingly engaging each of the first and second assemblies.

8. The apparatus according to claim 7, wherein the second assembly further includes an anchoring device, the anchoring device securing the sleeve within one of the first and second assemblies.

9. The apparatus according to claim 7, further comprising an anchoring device, the anchoring device biasing the first assembly toward the second assembly.

10. The apparatus according to claim 7, wherein the sleeve has a laterally inclined end surface formed thereon, and wherein the end surface is positioned relative to a flow passage formed laterally through a sidewall of the second assembly.

11. The apparatus according to claim 10, wherein the sleeve end surface forms a deflection surface for deflecting equipment from the first flow passage to the lateral flow passage.

12. The apparatus according to claim 7, wherein a shoulder formed on an upper deflection surface of the deflection device is engaged with a portion of the second assembly, such engagement preventing relative displacement therebetween.

13. The apparatus according to claim 7, wherein a flow passage formed laterally through a sidewall of the first assembly is in fluid communication with a tubular member sealingly disposed within a lateral wellbore of the well.

14. Apparatus operatively positionable within a subterranean well, the apparatus comprising:

a first assembly including a deflection device having a first flow passage formed generally axially therethrough; and a second assembly cooperatively engaged with the first assembly, the second assembly including a housing having a second flow passage formed generally axially therethrough and generally aligned with the first flow passage, a third flow passage formed through a sidewall portion of the housing, and a laterally inclined end surface of the housing being sealingly engaged with a complementarily shaped end surface of the deflection device.

15. The apparatus according to claim 14, further comprising a seal member disposed between the housing and deflection device end surfaces.

16. The apparatus according to claim 14, wherein the sealing engagement between the housing and deflection device end surfaces is a metal-to-metal seal.

17. The apparatus according to claim 14, wherein the housing is prevented from displacing relative to the deflection device by a shoulder formed on the deflection device end surface.

18. The apparatus according to claim 14, further comprising an anchoring device biasing the housing into contact with the deflection device.

19. A method of sealing a junction between first and second wellbores of a subterranean well, the method comprising the steps of:

positioning a first assembly in the first wellbore relative to the junction, the first assembly including a deflection device having a flow passage formed generally axially therethrough; and engaging a second assembly with the first assembly by displacing a sleeve, the sleeve being engaged with each of the first and second assemblies, and an axial flow passage of the second assembly being generally aligned with the deflection device flow passage.

20. The method according to claim 19, wherein the engaging step further comprises sealingly engaging the sleeve with each of the first and second assemblies.

21. The method according to claim 19, wherein the engaging step further comprises engaging an anchoring device attached to the sleeve with at least one of the first and second assemblies.

22. The method according to claim 21, wherein the anchoring device engaging step further comprises biasing the first and second assemblies together to thereby maintain the engagement therebetween.

23. The method according to claim 19, further comprising the step of setting an anchoring device in the first wellbore, thereby biasing the first and second assemblies together and maintaining the engagement therebetween.

24. The method according to claim 19, wherein the engaging step further comprises engaging a first shoulder formed on a housing of the second assembly with a second shoulder formed on the deflection device.

25. The method according to claim 19, wherein the engaging step further comprises aligning a laterally inclined end surface of the sleeve with a flow passage formed laterally through the second assembly.

26. A method of sealing a junction between first and second wellbores of a subterranean well, the method comprising the steps of:

positioning a deflection device in the first wellbore, the deflection device having an engagement surface formed thereon and a flow passage formed generally axially therethrough; and engaging a housing with the deflection device, an axial flow passage of the housing being aligned with the deflection device flow passage, a lateral flow passage of the housing being aligned with the second wellbore, an engagement surface formed on the housing engaging the deflection device engagement surface, and the housing sealingly engaging the deflection device.

27. The method according to claim 26, wherein in the engaging step, a seal member carried adjacent a laterally inclined lower surface of the housing is sealingly engaged with an upper laterally inclined seal surface of the deflection device.

28. The method according to claim 26, further comprising the step of setting an anchoring device in the first wellbore, the anchoring device applying a biasing force to the housing, thereby maintaining the housing in engagement with the deflection device.

29. The method according to claim 26, further comprising the step of inserting a first tubular member attached to the housing into the second wellbore, thereby providing fluid communication between the second wellbore and the lateral flow passage.

30. The method according to claim 29, further comprising the step of sealingly engaging the first tubular member with a second tubular member sealingly disposed within the second wellbore.

31. The method according to claim 26, wherein in the engaging step, a metal-to-metal seal is formed between the housing and the deflection device.

32. A method of sealing a junction between first and second wellbores of a subterranean well, the method comprising the steps of:

positioning a first assembly including a deflection device in the first wellbore relative to the wellbore junction, the deflection device having a first engagement surface formed thereon, and a first flow passage formed generally axially therethrough;

conveying a second assembly into the first wellbore, the second assembly including a seal member configured for sealing engagement with the first assembly, and a housing having second and third intersecting flow passages formed therethrough, and a second engagement surface formed thereon;

engaging the first and second engagement surfaces, thereby restricting displacement of the second assembly relative to the first assembly;

aligning the second flow passage with the first flow passage; and sealingly engaging the seal member with the first assembly, thereby forming a generally continuous pressure-bearing fluid passage through the first and second assemblies.

33. The method according to claim 32, wherein the second assembly further includes a first tubular member attached to the housing in fluid communication with the third flow passage, and further comprising the step of sealingly disposing the first tubular member within the second wellbore.

34. The method according to claim 33, wherein the sealingly disposing step further includes sealingly engaging the first tubular member with a second tubular member secured and sealingly disposed within the second wellbore.

35. The method according to claim 32, wherein the second assembly further includes a sleeve slidingly disposed within the housing, the sleeve carrying the seal member externally thereon, and wherein the sealingly engaging step further includes displacing the sleeve relative to the housing to sealingly engage the seal member with the first assembly.

36. The method according to claim 32, wherein the seal member is carried on the housing circumscribing the second flow passage, and wherein the sealingly engaging step further includes engaging the seal member with the deflection device.

* * * * *